US006564681B2

(12) United States Patent
Coulter

(10) Patent No.: US 6,564,681 B2
(45) Date of Patent: May 20, 2003

(54) NAIL SET HOLDER

(76) Inventor: Leigh H. Coulter, 5 Sibley Pl., Huntington Station, NY (US) 11746

( * ) Notice: Subject to any disclaimer, the term of this patent is extended or adjusted under 35 U.S.C. 154(b) by 0 days.

(21) Appl. No.: 09/947,653

(22) Filed: Sep. 6, 2001

(65) Prior Publication Data

US 2003/0041705 A1 Mar. 6, 2003

(51) Int. Cl.[7] ..... B25H 3/00
(52) U.S. Cl. ..... 81/487; 81/25
(58) Field of Search ..... 81/487, 44, 177.4, 81/490, 25, 27, 492; 30/167, 168; 125/40, 36

(56) References Cited

U.S. PATENT DOCUMENTS

| | | | | | |
|---|---|---|---|---|---|
| 334,283 | A | * | 1/1886 | Randall | 81/25 |
| 1,486,230 | A | * | 3/1924 | Cox | 81/487 |
| 1,540,990 | A | * | 6/1925 | Holdridge | 81/487 |
| 1,572,094 | A | * | 2/1926 | Todhunter | 81/487 |
| 2,043,442 | A | * | 6/1936 | McNeil | 81/487 |
| 2,211,682 | A | * | 8/1940 | Yeoman | 81/487 |
| 2,720,023 | A | * | 10/1955 | Koscher et al. | 30/168 |
| 3,952,618 | A | * | 4/1976 | Seamon | 81/900 |
| 5,632,186 | A | * | 5/1997 | Lin | 81/177.4 |
| 5,970,828 | A | * | 10/1999 | Bondhus et al. | 81/900 |
| 6,318,213 | B1 | * | 11/2001 | Hendrix et al. | 30/169 |

* cited by examiner

*Primary Examiner*—D. S. Meislin
(74) *Attorney, Agent, or Firm*—Alfred M. Walker

(57) ABSTRACT

A nail set holder holds a nail set, which is a punch, to drive nails into boards. The holder includes a hollow head with a sleeve therein for insertion of the nail set therein. The nail set is secured in place by fasteners, such as set screws. The handle is hollow, for enclosing alternate sized nail sets. It is proposed that the sleeve be large enough for larger nail sets, and the thinner ones can be held in place by setting the set screws in further, or by an auxiliary sleeve. Options also include a foam or rubber textured gripping surface on the handle body, and a shock absorber or caulking at the removable cap end to prevent loosening of the cap during vibrations of use.

18 Claims, 2 Drawing Sheets

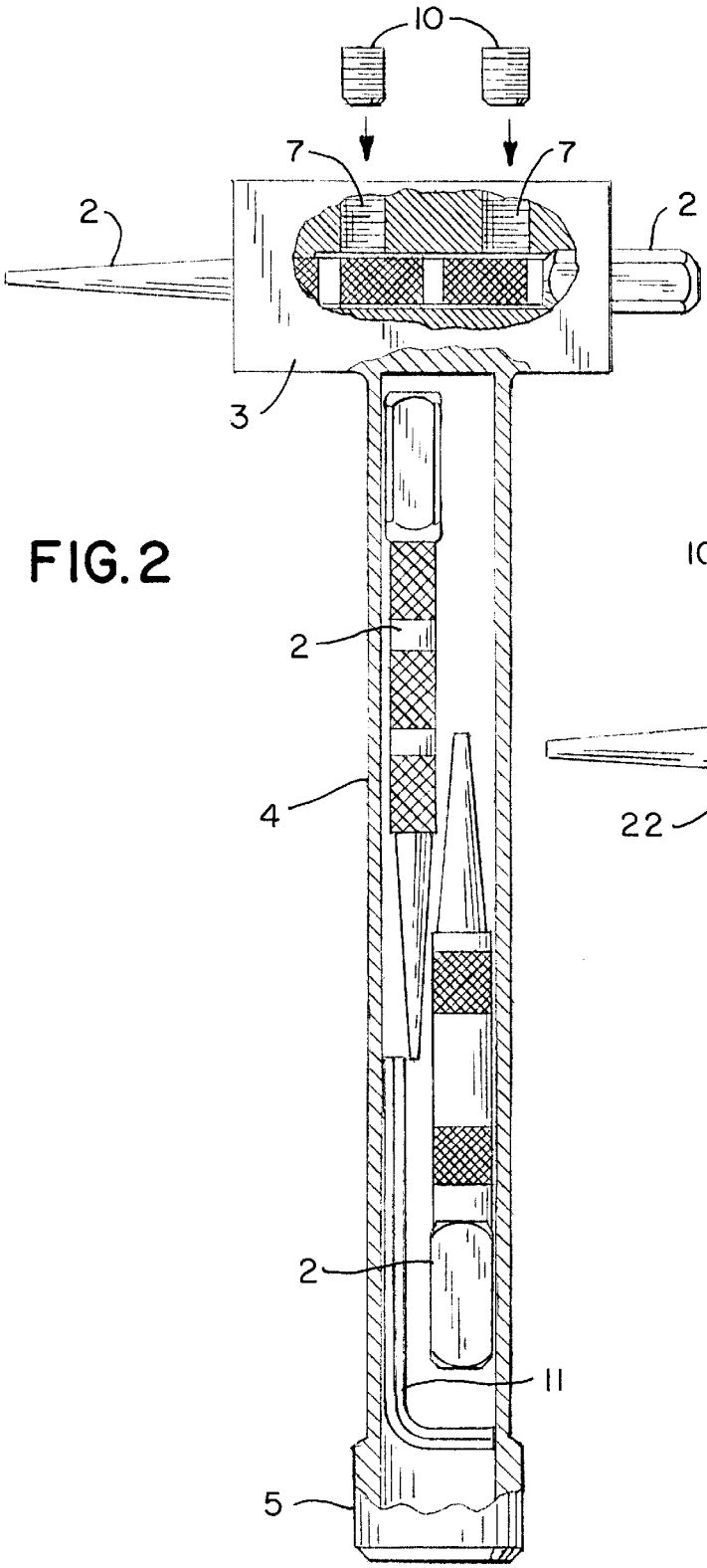
FIG. 2
FIG. 3
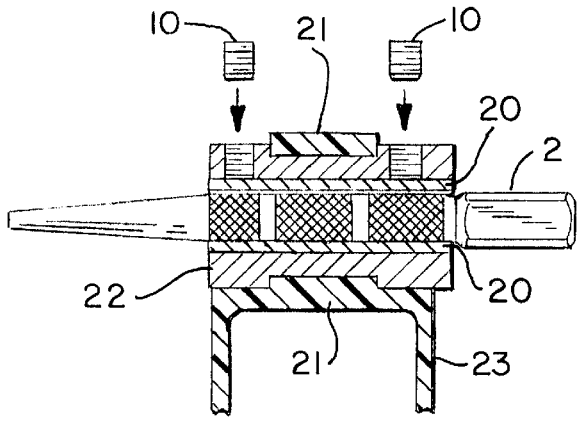
FIG. 4
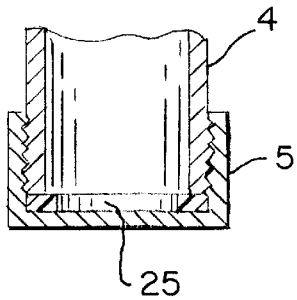

NAIL SET HOLDER

FIELD OF THE INVENTION

The invention relates to hand tools useful in nail setting.

BACKGROUND OF THE INVENTION

Known prior art includes U.S. Pat. No. 4,041,558 of Victor for a puncher and nail setter and U.S. Pat. No. 1,458,961 of Williams for a punch tool. Neither of these devices anticipate or render the present invention obvious.

OBJECTS OF THE INVENTION

It is an object of this invention to provide a nail set holding tool to reduce the possibility of damage to the workpiece.

It is another object of this invention to eliminate the possibility of causing injury by striking one's hand or fingers with a hammer while using a nail set.

It is also an object of this invention to keep a nail set secure, to prevent the possibility of the nail set flying out of the user's hand if hit incorrectly, thereby preventing damage to surrounding areas caused by the flying nail set.

It is a further object of this invention to permit more precise use of a nail set with appropriate hammer striking force by making the end of the nail set more visible during use and by eliminating any injury anxiety.

It is also an object of this invention to reduce the chance of repetitive task injury when using a nail set over long periods which could cause pain in the user's knuckles, fingers and wrist.

It is yet another object of this invention to prevent loss of a nail set by providing a convenient storage container to keep all sizes together.

SUMMARY OF THE INVENTION

In keeping with these objects and others which may become apparent, the present invention includes a tool for holding an impact tool, such as a nail set, which is a tapered tool applied to the head of a nail being driven into a board, wherein force is applied to a proximal end of the tool as the tapered distal end transfers that force to the head of the nail.

The nail set holder device of the present invention includes a hollow head with a bore sleeve therein for insertion of the nail set therein. The nail set is secured in place by fasteners, such as set screws.

The bore sleeve preferably covers all of the knurled portion (such as, for example, with ¼ inch being exposed) for better holding stability of the nail set within the sleeve.

The handle is preferably hollow, for enclosing alternate sized nail sets. It is proposed that the bore sleeve be large enough for larger nail sets, and the thinner ones can be held in place by setting the set screws in further, or by an auxiliary removable inner sleeve.

Options also include a foam or rubber textured gripping surface on the handle body, and a shock absorber at the removable cap end to prevent loosening of the cap during vibrations of use.

In the preferred embodiment, the holder for an impact tool, such as a nail set, includes a handle having a proximal end and a distal end, wherein the distal end is connected to and is substantially perpendicular to a portion of the proximal end of the handle. The distal end has a bore forming a permanent sleeve through its longitudinal axis, wherein the fore through the longitudinal axis of the head allows the impact tool, such as the nail set, to partially reside therein.

The proximal handle end further includes a bore therein covered by a cap, wherein this handle bore is receptive to store one or more impact tools therein. Preferable, the handle has an elastomeric cushion around its periphery, such as cushion grip of foam or rubber.

The impact tool, such as the nail set, is secured within the distal bore by one or more set screws, which contact the impact tool. In an optional embodiment, the distal bore has a removable sleeve to hold a thin impact tool, such as a nail set, therein.

BRIEF DESCRIPTION OF THE DRAWINGS

The present invention can best be understood in connection with the accompanying drawings. It is noted that the invention is not limited to the precise embodiments shown in drawings, in which:

FIG. 2 is a side elevational view of the nail set holder with crossectional details;

FIG. 3 is a side crossectional detail view of the head portion of the nail set holder, showing an optional size-reduction sleeve to accommodate nail sets with varying diameters;

FIG. 3A is a side crossectional detail view of an alternative embodiment for the head portion of a nail set holder, showing slanted indents for the fastener set screws; and FIG. 4 is a crossectional detail view of the end cap showing placement of an alternate embodiment for an elastomeric washer.

DETAILED DESCRIPTION OF THE INVENTION

Figure 1:
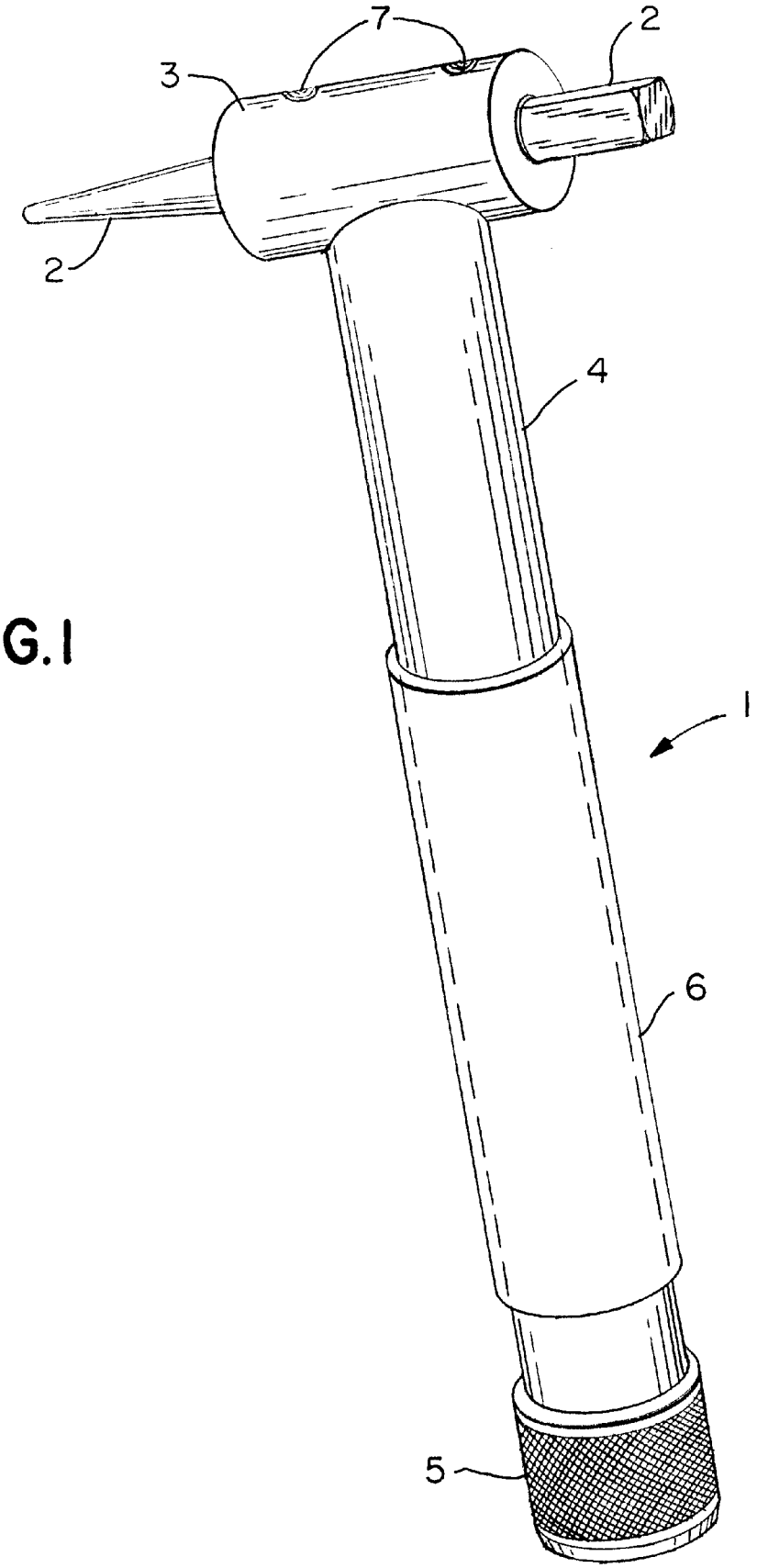
FIG. 1 is an isometric view of the nail set holder of this invention.

The present invention has broad applications to many technical fields for a variety of articles holding fastener drivers, such as nail sets. For illustrative purposes only, a preferred mode for carrying out the invention is described herein, wherein a nail set holder utilizes a hollow head firmly holding a nail set therein for the application of hammering force from above, while the user hammers a fastener, such as a nail, beneath the nail set punch.

FIG. 1 shows the nail set holder 1 of this invention. It is obvious from this figure that the user's hand are far removed from the hammer striking end during use, as opposed to the normal operation without the nail set holder, wherein the user has the risk of striking the hand holding a nail set.

Nail set holder 1 includes handle 4 and head 3 at a distal end thereof having a bore sleeve extending therethrough for holding an impact tool, such as nail set 2. Nail set holder 1 also includes end cap 5 at a proximal end of handle 4 with optional cushion grip 6. Nail set 2 is held in place by one or more fasteners, such as set screws, which are shown in threaded holes 7.

The side view of FIG. 2 reveals an optional storage cavity within handle 4 with space for at least two other nail sets 2 and for an allen wrench 11 to tighten set screws 10. Typically, nail sets come in three common tip sizes to accommodate finishing nails of different sizes. Thus all three nail sets 2 can be carried in one tool.

Nail set holder 1 can be fabricated by a number of different methods and in a variety of materials. For example, a two-part weldment of head 3 and handle 4 can form the structure out of steel or aluminum. A one-piece molded nail set holder structure can be injection molded from a variety of impact resistant thermoplastic resins such as acetal butyrate styrene (ABS), fiberglass reinforced nylon, or polycarbonate. Threaded metal inserts can be used to accommodate set screws 10 to reduce thread wear. Another fabrication alternative is metal injection molding, a newer innovation available from Phillips Plastics Corporation of Hudson, Wis.

Another embodiment, as shown in the head detail crossection of FIG. 3, illustrates the use of a plastic handle 23 attached to metal head 22 in a one-step molding process known as metal insert molding, whereby plastic is molded into a notch in head 22 thereby locking it in place by section 21 which fully encircles head 22.

FIG. 3 also illustrates the optional use of a removable sleeve 20 within the major hole in head 22; this is used to accommodate nail sets 2 with a smaller diameter. (This sleeve can also be used in head 3 as in FIGS. 1 and 2).

FIG. 4 shows the placement of an alternative form-fitting elastomeric washer 25 in the end of threaded cap 5. Such a washer 25 of a high friction material such as polyurethane will resist vibration loosening of cap 5 during typical use of nail set holder 1.

In an alternate embodiment nail set 2, as seen in FIG. 3A, may be indented or dimpled at 2*a,* the point of contact with set screw 10, to enhance tightening of set screw 10 against nail set 2. Moreover, in another alternate embodiment, threaded holes 7 accommodating set screws 10 therein may have indented, inwardly slanted edges 7*a,* to insure that the full length of set screw 10 is contained therein.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended claims.

I claim:

1. A holder for and in combination with a nail set comprising:

a nail set impact tool having an elongated cylindrical central body, said elongated central body having a predetermined elongated entire length, said nail set further having a tapered conical impact imparting head at a distal end thereof and an impact receiving head at an opposite proximal end of said nail set;

a straight, hollow handle, said hollow handle being cylindrical in cross section, said hollow handle having an open proximal end and a distal end, said hollow handle being adapted to accommodate nail sets of different sizes;

a cylindrical head integral with and mounted on said distal end, a longitudinal axis of said head being at right angles to a longitudinal axis of said hollow handle, said head having a bore through the longitudinal axis thereof;

said bore being adapted to receive and hold said nail set at right angles to said hollow handle;

said bore having an elongated length covering all of said predetermined elongated entire length of said elongated cylindrical central body of said nail set impact tool;

a plurality of spaced set screws mounted through a side wall of said head for engaging and tightening said nail set within said bore; and, a removable end cap for closing the opening of said of said hollow handle.

2. A holder according to claim 1, wherein said handle has an elastomer around its periphery.

3. A holder according to claim 2, wherein said elastomer is a cushion grip.

4. A holder according to claim 2, wherein said elastomer is foam.

5. A holder according to claim 2, wherein said elastomer is rubber.

6. A holder according to claim 1, wherein said end cap further includes a washer therein.

7. A holder according to claim 6, wherein said washer is polyurethane.

8. A holder according to claim 1, wherein said holder is made of an alloy.

9. A holder according to claim 8, wherein said alloy is aluminum.

10. A holder according to claim 1, wherein said holder is made of resin.

11. A holder according to claim 10, wherein said resin is fiberglass reinforced nylon.

12. A holder according to claim 10, wherein said resin is acetal butyrate styrene.

13. A holder according to claim 10, wherein said resin is polycarbonate.

14. The holder as in claim 1 wherein said end cap is knurled.

15. A holder for and in combination with a nail set consisting essentially of:

a nail set impact tool having an elongated cylindrical central body, said elongated central body having a predetermined elongated entire length, said nail set further having a tapered conical impact imparting head at a distal end thereof and an impact receiving head at an opposite proximal end of said nail set;

a straight, hollow handle being cylindrical in cross section, said hollow handle having an open proximal end and a distal end, said hollow handle being adapted to accommodate nail sets of different sizes;

a cylindrical head integral with and mounted on said distal end, a longitudinal axis of said head being at right angles to a longitudinal axis of said hollow handle, said head having a bore through the longitudinal axis thereof;

said bore being adapted to receive and hold said nail set impact tool at right angles to said hollow handle;

said bore having an elongated length covering all of said predetermined elongated entire length of said elongated cylindrical central body of said nail set impact tool, a plurality of spaced set screws mounted through a side wall of said head for engaging and tightening said nail set within said bore;

a removable end cap for closing the opening of said of said hollow handle; and a cushion grip mounted on said hollow handle between said end cap and said head.

16. A holder as in claim 15 in which said cylindrical head is metal and said handle is plastic, said plastic being molded into a notch in and completely encircling said head, thereby locking said head in place at the distal end of said handle.

17. The holder as in claim 15 wherein said end cap is knurled.

18. A holder for and in combination with a nail set comprising:

a nail set impact tool having an elongated cylindrical central body, said elongated central body having a predetermined elongated entire length, said nail set further having a tapered conical impact imparting head at a distal end thereof and an impact receiving head at an opposite proximal end of said nail set;

a straight, hollow handle cylindrical in cross section having an open proximal end and a distal end, said hollow handle being adapted to accommodate nail sets of different sizes;

a cylindrical head integral with and mounted on said distal end, a longitudinal axis of said head being at right angles to a longitudinal axis of said handle, said head having a bore through the longitudinal axis thereof;

said bore being adapted to receive and hold said nail set at right angles to said handle;

said bore having an elongated length covering all of said predetermined elongated entire length of said elongated cylindrical central body of said nail set impact tool;

a removable sleeve disposed within said bore to accommodate nail sets of different diameters;

a plurality of spaced set screws mounted through a side wall of said head for engaging said sleeve and tightening said sleeve against said nail set within said bore; and, a removable end cap for closing the opening of said handle.

* * * * *